US011512934B2

(12) United States Patent
Isringhausen

(10) Patent No.: US 11,512,934 B2
(45) Date of Patent: Nov. 29, 2022

(54) DUAL SPREADING ARROWHEAD

(71) Applicant: Kenneth A. Isringhausen, Carrollton, IL (US)

(72) Inventor: Kenneth A. Isringhausen, Carrollton, IL (US)

( * ) Notice: Subject to any disclaimer, the term of this patent is extended or adjusted under 35 U.S.C. 154(b) by 0 days.

(21) Appl. No.: 17/410,734

(22) Filed: Aug. 24, 2021

(65) Prior Publication Data

US 2022/0057180 A1 Feb. 24, 2022

Related U.S. Application Data

(60) Provisional application No. 63/069,484, filed on Aug. 24, 2020.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | | |
|---|---|---|---|---|
| 2,820,634 | A * | 1/1958 | Vance | F42B 6/08 43/6 |
| 4,099,720 | A * | 7/1978 | Zeren | F42B 6/08 473/584 |
| 5,046,744 | A * | 9/1991 | Eddy | F42B 6/08 473/583 |
| 6,398,676 | B1 * | 6/2002 | Mizek | F42B 6/08 473/583 |
| 9,021,958 | B1 * | 5/2015 | Bradbury | F42B 6/08 102/400 |
| 9,879,955 | B2 * | 1/2018 | Rowley | F42B 6/08 |
| 10,415,940 | B2 * | 9/2019 | Sullivan | F42B 12/34 |
| 10,436,556 | B1 * | 10/2019 | Ohlau | F42B 6/08 |
| 2017/0184381 | A1 * | 6/2017 | Loa | F42B 6/08 |

* cited by examiner

*Primary Examiner* — John A Ricci
(74) *Attorney, Agent, or Firm* — Charles McCloskey

(57) ABSTRACT

A dual spreading arrowhead has components and operations that cut on contact with an animal. The dual spreading arrowhead has a left blade and a right blade mutually pinned to a head. The head secures to a shaft of an arrow. The left blade and the right blade each have a pointed tip and two sharpened edges. Opposite the tip, each blade has a rounded foot that travels within a slot through the head and upon a shaped spacer. Between the foot and the tip, each blade has a spine not sharpened. The arrowhead has a flight position with the tips near each other but not overlapped and a deployed position with the blades rotated outwardly and the sharpened edges mutually forward. The arrowhead utilizes the momentum of the flying arrow shaft to adjust the invention from the flight position to the deployed position.

16 Claims, 3 Drawing Sheets

DUAL SPREADING ARROWHEAD

CROSS-REFERENCE TO RELATED APPLICATION

This non-provisional application claims priority to pending provisional application No. 63/069,484 filed on Aug. 24, 2020 and both are owned by the same inventor.

BACKGROUND OF THE INVENTION

The present invention relates generally to archery and more particularly to arrowheads, used against game, that cut on contact. The dual spreading arrowhead has particular utility with contacting game, incising a lengthy wound in the game, and then retaining itself within the game until released at the discretion of the archer.

Grown tired of plants and small mammals, man has sought game as sustenance for millennia. Game has taken many forms over the centuries. It generally provides protein to man when consumed and before that the challenge of a hunt. Over the centuries, man's hunting of game has taken the less savvy game and stimulated remaining game to become smarter and more cunning against man. Presently, man hunts various animals with deer, elk, and hogs calling forth many a hunter. A portion of those hunters use archery to take their game: bow hunters.

A deer is a lively creature with a camouflaged body and wily personality. Deer are at home in the forests and woods. An elk is a strong creature with a distinctive call and pronounced horns. Elk call forest, meadow, and mountainside home. A hog is a lively creature with a short legged body, wily personality, and ornery temperament. Hogs blend into the forests, woods, fields, and plains. For a bow hunter to seek these quarry successfully, it takes skill and good equipment.

Hunting once had its industrial operations that brought hosts of hunters by train to hunting grounds. Modern ranching and agriculture raise herds of cattle, flocks of chickens, and herds of select swine. Unless one from the herds or the flocks escapes, a bow hunter need not take on a cow, a chicken, or a swine. Bow hunting though for the most part has individuals who seek game, such as deer, elk, or hogs within applicable limits for consumption or for pest eradication. This application and invention serve the individual bow hunter. In recent decades, bow hunting has evolved from a sustenance activity to a sport.

The dual spreading arrowhead of the present invention is desirable for smooth flight of an arrow to game, incision into the game, and then embedment within the game so that the game drops on the spot. Bow hunters dislike loss of an animal after diligent pursuit, rough weather, difficult terrain, and the like. Though the loss of an animal raises tales aplenty, those who have hunted know the ill will generated when game gets away.

From time to time, a bow hunter receives inspiration to improve his gear. A bow hunter analyzes the game and its behavior and may notice a better way to take down an animal. The running and turning action of an animal may remove it from a hook, a lance, or a plain arrowhead. Other components may drop the animal though the bow hunter must deliver those components to the animal itself.

Many bow hunters have used their own gear, devices, and tracking to catch game. That long tradition continues to this day. Though this description has used man in its general sense for all persons and bow hunters in its more specific sense, modern hunters include many women. As this application goes forward, the usage of the term bow hunters is meant to include women.

DESCRIPTION OF THE PRIOR ART

Bow hunters benefit from the equipment and techniques that came before them. Bow hunters use arrows initially designed for target shooting and then the pursuit of game. Such arrows generally fly through air and then impact and enter a target. The arrow's flight velocity and momentum allow it to penetrate well into a target as many a hay bale can attest. However, an arrow behaves differently when engaging moving game in the woods and fields and an animal behaves and darts aplenty.

In ancient times, man used spears thrown directly at game. Man must see the game for the spear and its technique to succeed. Man generally attempts this in good weather and with good visibility on the terrain. Man must have clear vision and a strong arm to succeed at spearing game. A hunting spear generally has a long shaft and a sharpened tip. When thrown, the spear flies towards an animal on a ballistic path and with a little luck, the spear enters an animal and the animal expires promptly with the spear extending from it.

Along with spears, recent decades have had man use archery to take game. An archer spots an animal seen through the woods or across a field then shoots an arrow towards the target animal. With a little luck, the arrowhead penetrates the animal, the animal remains upon the arrow's shaft, and the hunter finds the arrow. Many a hunter has seen an animal run off with an arrow and the terrain takes an animal from him. Select hunters have shot arrows having lines attached to them towards animal targets. The lines assist in retrieving the arrows and any animals at their ends. However, the lines affect the flight characteristics of the arrows, and thus the accuracy of hitting a fish. For worse, the lines entangle in brush, compromising a shot.

Though preceding description has referred to hunting in woods and in fields, the description also applies to hunting in deserts, swamp lands, along water courses, near the mountains, and aboard vehicles where permitted around the world. While the above-described devices fulfill their respective, particular objectives and requirements, the aforementioned devices do not describe a dual spreading arrowhead that reaches an animal, incises it, drops it on the spot, and then keeps the animal secured upon it.

Therefore, a need exists for new and improved dual spreading arrowhead that can be used for reaching an animal, incising the animal, dropping the animal promptly, retaining the animal upon the arrowhead, and then releasing the animal to the bow hunter upon command. In this regard, the present invention substantially fulfills this need. In this respect, the dual spreading arrowhead according to the present invention substantially departs from the conventional concepts and designs of the prior art, and in doing so provides a device primarily developed for the purpose of retaining a fish upon an arrowhead and related shaft in nearly any fishing location.

The dual spreading arrowhead overcomes the above-mentioned disadvantages and drawbacks of the prior art. As such, the general purpose of the present invention, which will be described subsequently in greater detail, is to provide a new and improved dual spreading arrowhead which has all the advantages of the prior art mentioned heretofore and many novel features that result in a dual spreading arrowhead which are not anticipated, rendered obvious, suggested, or even implied by the prior art, either alone or in any combination thereof.

SUMMARY OF THE INVENTION

The dual spreading arrowhead has components and operations that cut on contact with an animal. The dual spreading arrowhead has a left blade and a right blade mutually pinned to a head. The head secures to a shaft of an arrow. The left blade and the right blade each have a pointed tip and two sharpened edges. Opposite the tip, each blade has a rounded foot that travels within a slot through the head and upon a shaped spacer. Between the foot and the tip, each blade has a spine not sharpened. The arrowhead has a flight position with the tips near each other but not overlapped and a deployed position with the blades rotated outwardly and the sharpened edges mutually forward. The arrowhead utilizes the momentum of the flying arrow shaft to adjust the invention from the flight position to the deployed position.

There has thus been outlined, rather broadly, the more important features of the invention in order that the detailed description thereof that follows may be better understood and in order that the present contribution to the art may be better appreciated. Additional features of the invention will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and devices for carrying out the several purposes of the present invention. It is important, therefore, that the claims be regarded as including such equivalent constructions insofar as they do not depart from the spirit and the scope of the present invention.

It is therefore an object of the present invention to provide a new and improved dual spreading arrowhead that cuts into a target on contact with the target, cut on contact.

Another object of the present invention is to provide a dual spreading arrowhead that may be easily and efficiently manufactured and marketed to the consuming public.

Another object of the present invention is to provide a dual spreading arrowhead for smooth flight of an arrow to a waiting target.

Another object of the present invention is to provide a dual spreading arrowhead that incises an animal's hide, enters the animal's body, and engages it preventing the animal from sliding off the arrowhead.

Another object of the present invention is to provide a dual spreading arrowhead that has a minimal ferrule.

Another object of the present invention is to provide a dual spreading arrowhead that a bow hunter may release from an animal without further tearing the animal.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

In referring to the drawings.

The same reference numerals refer to the same parts throughout the various figures.

DESCRIPTION OF THE PREFERRED EMBODIMENT

Figure 1:
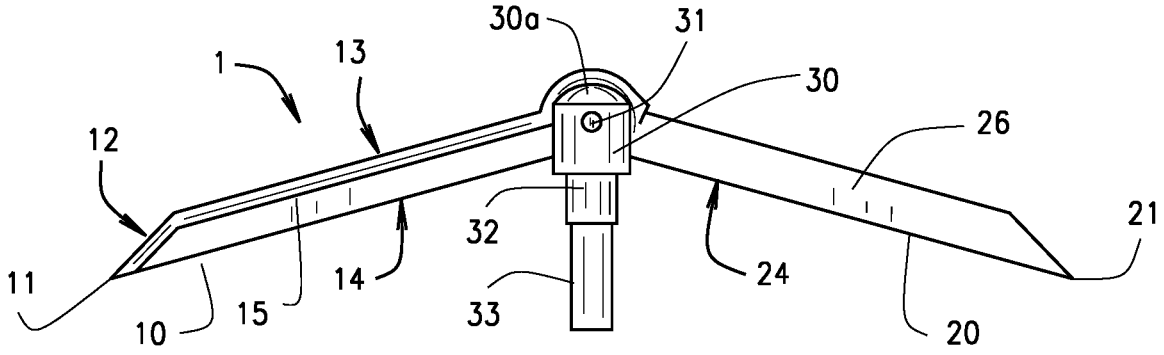
FIG. 1 is a top view of the preferred embodiment of the present invention in the deployed position.
Figure 2:
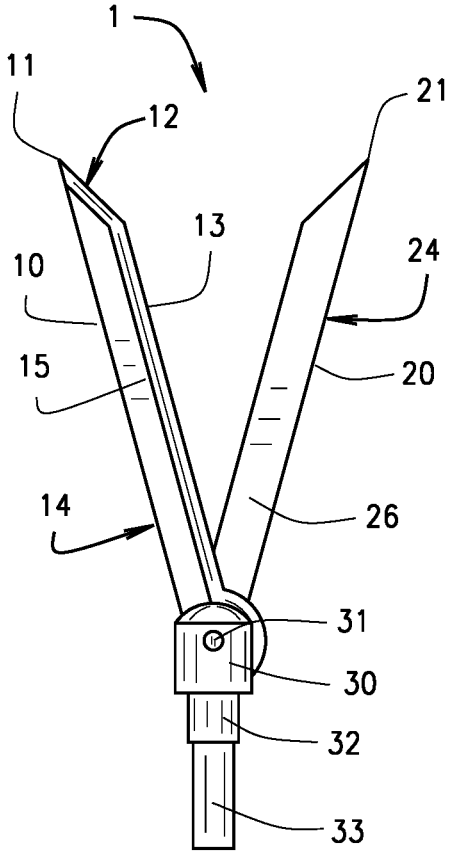
FIG. 2 is a top view of the preferred embodiment of the present invention in the flight position.

Referring now to the drawings, and particularly to FIGS. 1 through 8, a preferred embodiment of the dual spreading arrowhead of the present invention is shown by the reference numeral 1. In FIG. 1, the present invention 1 appears in a top view of its deployed position, or open position. The deployed position occurs after the invention has contacted a target, such as a deer or a hog, and the arrow shaft connected to the invention continues into the target. The momentum of the arrow shaft from its flight propels the center of the invention into the target while other components of the invention engage the hide of the target. Friction between the target's hide and the other components of the invention, opens the invention as shown in FIG. 1. A target, such as a deer or a hog, hit in its chest cavity with the invention as shown in FIG. 1 suffers a fatal wound that dispatches the target quickly. The present invention operates upon mechanical principles that make it cut on contact.

Turning to the invention 1, it has a left blade 10 and an opposite right blade 20. The left blade has a tip 11 here shown outwardly. Inwardly from the tip, the left blade has a trapezoidal like shape with a first edge 12 extending inwardly and upwardly from the tip 11. The first edge is a sharpened edge, one side only in one direction. Spaced forward and away from the tip, the first edge has an angled transition to a second edge 13, alternatively the angled transition is called a foot. The second edge extends inwardly from the first edge towards the center of the invention. The second edge is also a sharpened edge, one side only in one direction. Spaced rearward from the second edge and parallel to it, the left blade has a spine 14 that defines the thickness of the left blade. The spine extends from nearly the center of the invention from the third edge outwardly to the tip 11 as shown. The spine does not have sharpening. Between the terminus of the sharpening on the first edge and the second edge and the spine, the left blade has its front 15 also of a trapezoidal shape truncated by the terminus. The front spans between the first edge, the second edge, the third edge, and the spine. Opposite the front, the left blade has its back. The back is mutually parallel and spaced apart from the front.

Similar to the left blade, the invention has its right blade 20 to the right of the left blade in this figure. The right blade has its tip 21 here shown outwardly and the same distance rearward as the tip 11 of the left blade. Inwardly from the tip, the right blade has its trapezoidal like shape as shown. The right blade widens and extends inwardly from the tip towards the center of the invention. Similar to the first edge 12 of the left blade, the right blade attains a constant width for most of its length as shown. Spaced outwardly from the center of the invention and to the tip 21, the right blade has its spine 24 that defines the thickness of this blade. The spine does not have sharpening and shows the thickness of this blade also. The right blade has a shape of similar length and width as that of the left blade as shown. Between the tip 21, the spine, and the center of the invention, the right blade has its back 26 shown as a flat plane slightly recessed into the plane of this figure. The back spans between the first edge, the second edge, the third edge, and the spine. The back is mutually parallel and spaced apart from the front.

The left blade 10 and the right blade 20 mutually connect upon a pin 31 placed into a head 30 generally in the center of the invention. The pin has a cylindrical shape with a length greater than its diameter and a diameter less than the width of the second edge 13 of the left blade. As later shown in FIG. 8, the head has a slot that permits rotation of the left blade and the right blade within it from the flight position to the deployed position. The left blade and the right blade mutually rotate outwardly to attain an obtuse angle between them from at least 180 degrees to about 225 degrees when in the deployed position as during a hunt. The head has a generally cylindrical form with a diameter similar to its length as shown. The head has beveling around its forward face, 30*a*, that engages the target first. Opposite and spaced rearward form the forward face, the head has its round neck 32 of lesser diameter than the head and with its own length proportional to its diameter as shown. Outwardly from the neck, the invention has its round stem 33 with its diameter less than that of the neck but a length greater than its diameter. In summary, the neck has a diameter less than that of the head, and the stem has a diameter less than that of the neck. In an alternate embodiment, the stem has threading for engagement into an arrow shaft. In an alternate embodiment, the stem has vanes for embedment into an arrow shaft. In a further alternate embodiment, the stem has a bayonet type lock for cooperative engagement into an arrow shaft.

Before the invention attains the deployed position shown in FIG. 1, the invention flies upon an arrow shaft fired by a bow hunter from his bow. The invention flies through the air in its flight position shown in top view of FIG. 2. The arrowhead has its flight position with the left blade 10 and the right blade 20 brought close to each other but not touching. The left blade and the right blade mutually rotate inwardly to attain an acute between them from about 5 degrees to about 45 degrees when in the flight position. The friction between the two blades, the blades against the head, and the blades upon the pin prevents the blades from opening during flight. As before, the arrowhead of the invention begins with the stem 33 that then enlarges to the neck 32 which then joins to the head 30. Away from the neck, the invention has its head 30 with an elongated cylinder 31, preferably a pin, placed transverse the head, that is, perpendicular to a centerline through the stem. The pin permits rotation of the left blade 10 and the right blade 20 mutually outward from the flight position shown in this figure to the deployed position previously shown in FIG. 1. Turning to the left blade 10, it has its spine here shown outwardly but pointed upwardly in this figure. The spine 14 has the thickness of the left blade but without sharpening. The spine extends nearly radially from the center of the head outwardly to a tip 11 of the left blade. The tip is the uppermost and outermost portion of the left blade. Downwardly and inwardly from the tip, the left blade has its sharpened first edge 12. The first edge extends partially along the length of the left blade and across its width, forming a sloped line as akin to a trapezoid. The left blade then has an angular transition from the first edge to the second edge 13 where the second edge is parallel to the spine and inward from the first edge towards the center of the invention. Between the spine, the first edge, and the second edge, the left blade shows its front 15 in this figure.

Rotated outwardly from a centerline through the stem, the right blade 20 has the same angle from the centerline as the left blade. The right blade has its tip 21 generally the same distance outwardly from the pin as the tip 11 of the left blade. From the tip 21, the right blade has its spine 24 extend inwardly towards the center of the invention, that is, the head 30, The spine 24 extends for the length of the right blade. Spaced inwardly from the spine, the right blade has its back 26 have a generally trapezoidal shape as shown. The tips 11, 21 are mutually spaced outwardly. Just milliseconds before the arrowhead reaches the deployed position, the tips 11, 21 contact the hide of the target and puncture it in cooperation with the first edges of both blades. The first edge 12 of the left blade and its right blade counterpart elongate the puncture into a pair of spaced apart incisions of the target. The first edges of both blades start the rotation of the blades outwardly from the flight position after contact towards the deployed position. The arrow shaft's momentum imparted to the stem, into the head, and then into the left blade and the right blade advances the second edge 13 of the left blade and its right blade counterpart inwardly from the initial incisions thus combining into a large incision of about four inches in length. The two blades stack back to back as shown. The two tips position away from the head in both the flight position and the deployed position. The two tips also orient mutually outwardly as shown in this figure and in FIG. 1.

Figure 3:
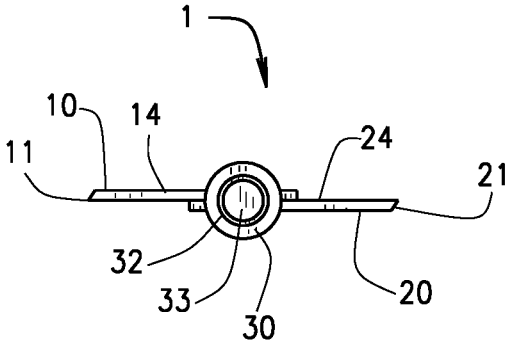
FIG. 3 is a back view of the present invention in the flight position.

FIG. 3 then shows a back view of the invention in the flight position. A bow hunter would see this after nocking an arrow for use. With an arrow shaft not shown, the stem 33 appears in the center of this figure. The stem has its round shape of the smallest diameter of the central components of the invention. Inwardly into the plane of this figure, the neck 32 expands slightly outwardly from the stem. Then inwardly again into the plane of this figure, the head 30 expands noticeably from the neck. The head has its round shape of the largest diameter for the invention's central components. Towards the left of the head, this figure shows the left blade 10 with its spine 14 visible to the reader. At the far left of the left blade, it has its tip 11 as before. Outwardly from the head and the left blade, the invention has its right blade 20. The right blade has an orientation slightly below that of the left blade such that the back 26 of the right blade is nearly coplanar with the back of the left blade. More particularly, the back 26 of the right blade is mutually parallel to and spaced beneath the front 15 of the left blade.

Figure 4:
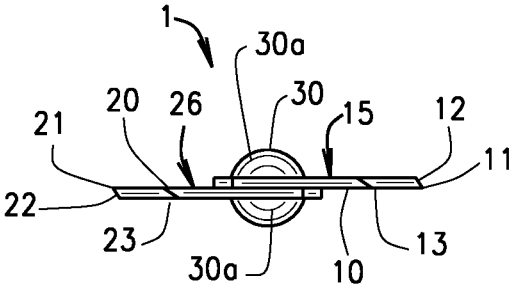
FIG. 4 is a front view of the present invention in flight position.

Opposite FIG. 3, FIG. 4 shows a front view of the invention in its flight position moments before contacting the target. From the left of this figure, the right blade 20 has its tip 21 farthest to the left. Inwardly from the tip, the right blade has its first edge 22, here shown on edge, then an angular transition to its second edge 23 that extends inwardly with the right blade into the head. Spaced above the back 26 of the right blade, the second edge 13 of the left blade extends outwardly from the head. At an angular transition, the second edge turns to the first edge 12 of the left blade, here shown on edge. The first edge then ends to the right of this figure in the tip 11. The back 26 of the right blade abuts the left blade 10 particularly in the vicinity of the head 30. Moreover the head has its forward face 30*a* visible in this figure upwardly from the left blade in the head and downwardly from the right blade also in the head.

Figure 5:
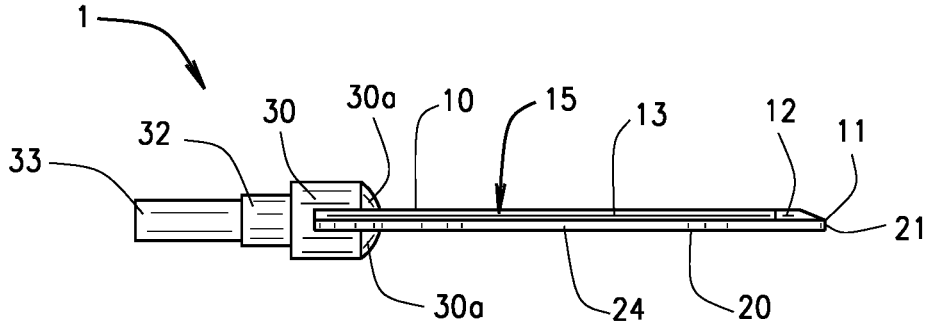
FIG. 5 is a side view of the present invention in the flight position.

After the bow hunter nocks an arrow, aims its, and fires it, the invention flies to the target with its blades near each other as shown from the side in FIG. 5. The left blade 10 appears above the right blade 20 in the right portion of this figure. The left blade has its front 15 towards the top with the first edge 12 to the right and the tip 11 at the rightmost of the figure. Beneath the left blade, the right blade has its spine 24 shown towards the reader and its tip 21 to the right most in this figure. The left blade and the right blade both approach the head 30 proximate its forward face 30*a* opposite the tips 11, 21. The left blade and the right blade are mutually parallel. The head having received the blades, extends to the left of the figure and the neck joins to it along the centerline and longitudinal axis of the invention and the head has its collinear longitudinal axis. Of lesser diameter and more length than the neck, the stem extends further to the left in this figure.

Figure 6:
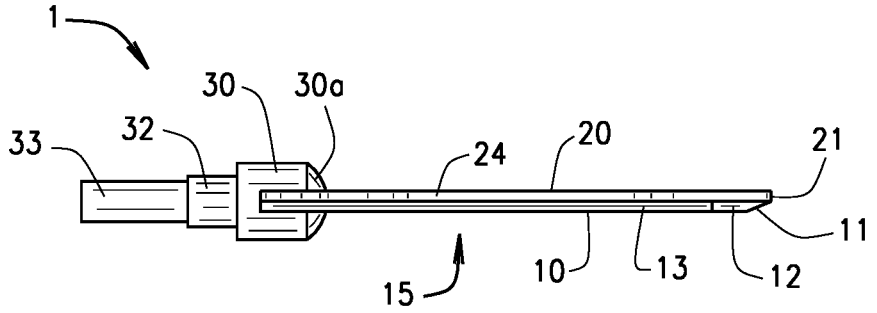
FIG. 6 is a side view of the present invention in the flight position opposite that of FIG. 5.

Rotating the invention about its longitudinal axis, FIG. 6 shows the other side view of the invention. Here, the invention has its right blade 20 upwardly with its tip 21 to the right and its spine 24 visible. In this view, beneath the right blade, the invention has its left blade 10 with its front 15 towards the bottom then its second edge 13 shown along most of its length towards the right. The second edge then has its angular transition to the first edge 12 that then ends in the left blades tip 11. The two blades then pivotally connected to the head 30 about its forward face 30*a*. The head then has the neck 32 that terminates in the stem 33.

Figure 7:
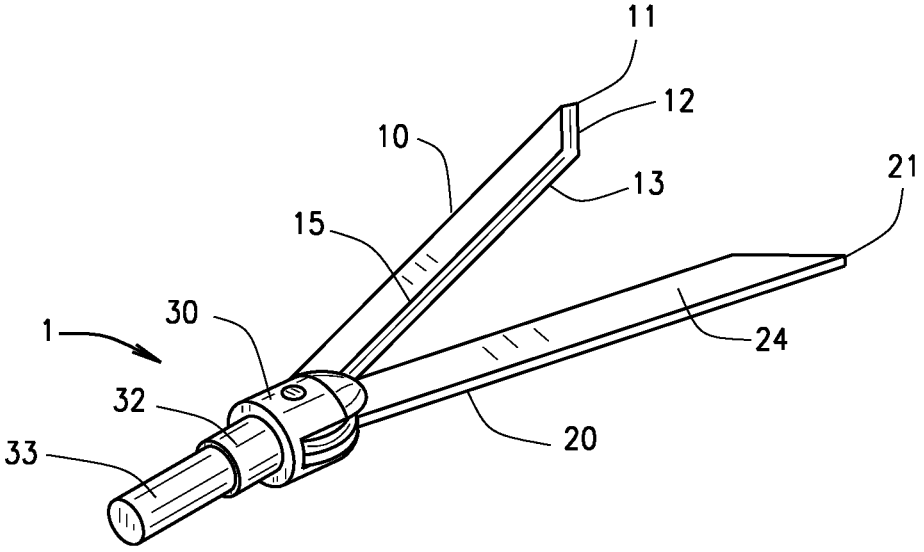
FIG. 7 is a perspective view of the present invention in the flight position.

FIG. 7 shows the invention in flight in a perspective view the tips 11, 21 to the upper right of the figure. The invention has the stem 33, neck 32, and head 30 as before. The left blade 10 and the right blade 20 open and extend outwardly from the head to the right. The left blade presents it second edge 13 and its first edge 12 to the back 26 of the right blade. As later shown, the blades have the same geometry and construction so that the right blade presents its first edge and its second edge to a back of the left blade.

Figure 8:
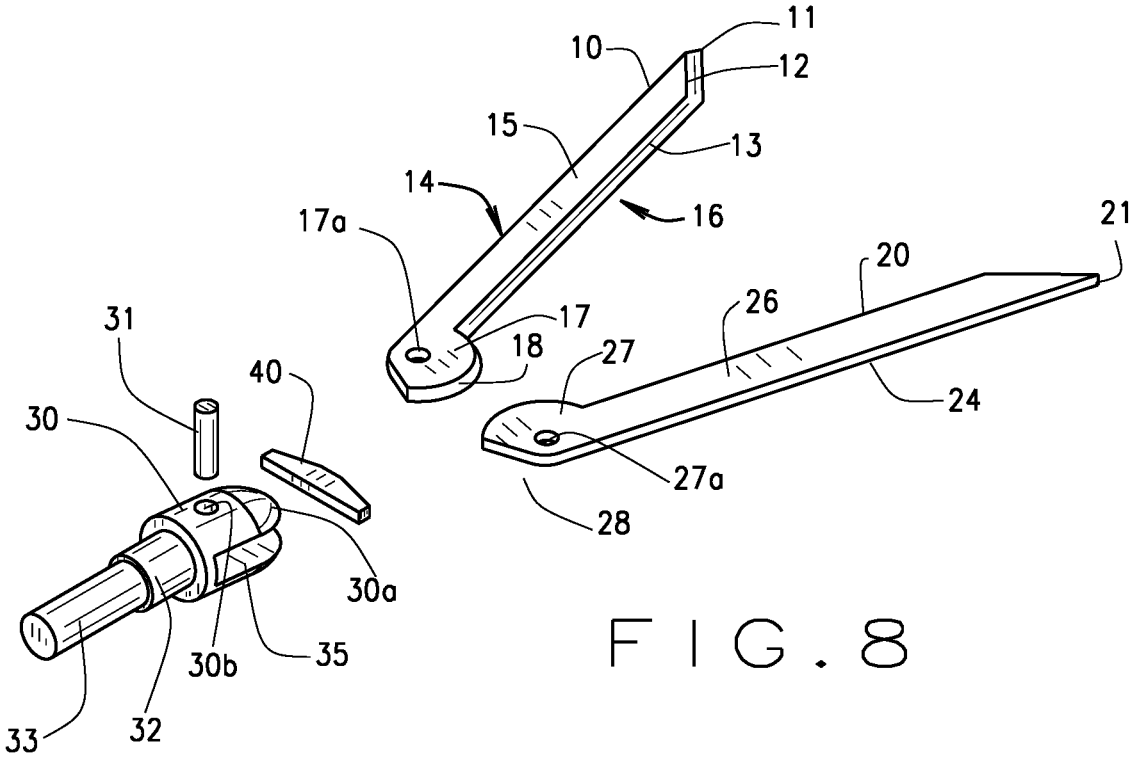
FIG. 8 is an exploded view of the preferred embodiment.

FIG. 8 has an exploded view of the preferred embodiment of invention previously shown in FIG. 7. The stem 33 and the neck 32 extend beneath the head 30 as described before. The head also has a slot 35 generally transverse to the longitudinal axis of the invention and of the head and for nearly the full length of the head. Preferably, the slot has its depth at least half of the length of the head. The head also has a pair of coaxial apertures 30*b* just inward from a forward surface 30*a* oriented toward the blades. The apertures have a perpendicular orientation, or transverse, to receive pin into the slot and to the longitudinal axis of the invention. The apertures receive the elongated cylinder 31, or pin, that spans from one aperture, across the slot, and into the second aperture. The pin has sufficient frictional engagement to the apertures that it remains in position during flight and usage upon and in a target.

The slot also receives a spacer 40 of a generally prismatic form. The spacer has two beveled surfaces here shown outwardly of the head and a flat portion centered between the two surfaces as shown. The flat portion is mutually parallel and spaced apart from a flat base of the spacer here shown towards the forward surface of the head. Each beveled surface is at least 150% the width of the flat portion. The beveled surfaces rise less than 50% of the outside thickness of the spacer. The spacer 40 plays a key role in the operations of this invention.

The beveled surfaces have the two blades, 10, 20, turn upon them. As before, the left blade 10 has its tip 11, first edge 12 sharpened, second edge 13 sharpened, spine 14 opposite the second edge, front 15 and opposite back 16. As previously shown emplaced in the head, the left blade has its rounded shoulder 17, or foot, opposite the tip 11. The foot has its diameter greater than the width of the front 15 and effectively widening the blade. The foot has a sharpened third edge 18 that starts at the second edge then curves around the foot, or rotates, for over ninety degrees of rotation but less than one hundred eighty degrees of rotation. Opposite the third edge, the foot has an angled portion that returns to the spine. The angled portion has a square edge in contrast to the third edge. The angled portion abuts a beveled surface of the spacer when the invention attains its flight position. The foot retains the left blade in its flight position before and during flight. The spacer places into the interior of the head and of the blades. The square edges of the feet, or shoulders, cooperate with the spacer to retain the blades in their flight position until the tips cut a target upon contact and the blades then open into the deployed position.

When the invention attains the deployed position, the beveled surfaces of the spacer 40 cooperate with the feet of both blades so that the blades attain the maximal opening angle as previously shown in FIG. 1. The foot of the left blade also has a precisely located aperture 17*a* that cooperatively engages with the pin 31 upon assembly of the invention. Opposite the left blade, the invention has its right blade 20. The right blade 20 also has its tip 21, first edge 22 sharpened, second edge 23 sharpened, spine 24 opposite the second edge, front and opposite back. As previously shown emplaced in the head stacked beneath the left blade, the right blade has its rounded shoulder 27, or foot, akin to that of the left blade, opposite the tip 21. The foot has its diameter greater than the width of the back 26, that is, greater than the distance from the spine to the second edge, and effectively widening the blade. The foot has a sharpened third edge 28 that starts at the second edge then curves around the foot for over 90 degrees of rotation but less than 270 degrees of rotation. Opposite the third edge, the foot has an angled portion with a square edge and that returns to the spine. The square edge attains an angle to the longitudinal axis of the arrowhead. The angled portion abuts the second beveled surface of the spacer when the invention attains its flight position. The foot retains the right blade in the flight position before and during flight. The foot also has its precisely located aperture 27*a* that cooperatively engages with the pin 31 and aligns with the left foot's aperture upon assembly of the invention. The tips, first edges, second edges, feet, spacer, and third edges cooperate so that upon the invention barely contacting a target's fur in the flight position, the invention can do nothing but open in the milliseconds of its entry into the target. As suggested by the drawings, the left blade and the right blade have similar components as the right blade is merely the left blade rotated one hundred eighty degrees along its longitudinal axis. The first edges, second edges, and third edges of both blades have sharpening on one side only in one direction. The present invention optimizes its strength to weight because of its flight through air. Preferably, the invention has a weight less than 651 grains.

Figure 9:
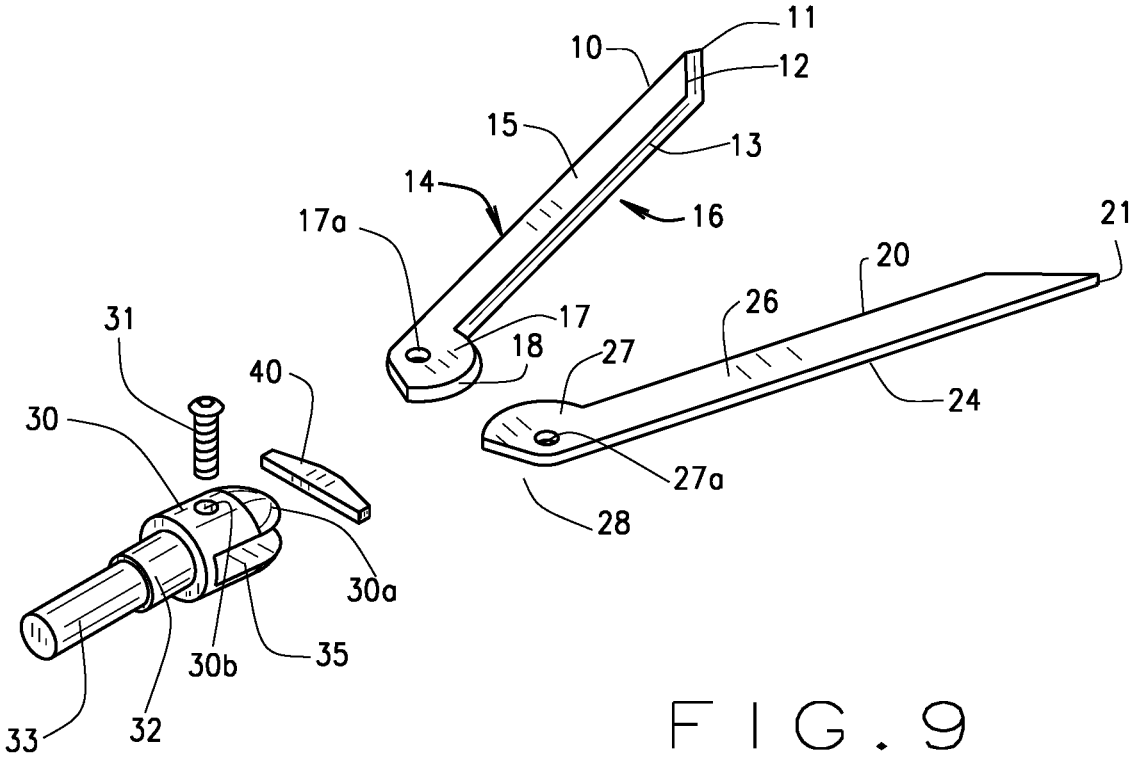
FIG. 9 is an exploded view of an alternate embodiment.

And FIG. 9 has an exploded view of an alternate embodiment of the invention previously shown in FIG. 7. The stem 33 and the neck 32 extend beneath the head 30 as described before. The head also has a pair of collinear apertures 30*b*, here threaded, just inward from the forward surface 30*a*. The apertures have a perpendicular orientation to the slot and to the longitudinal axis of the invention. The apertures receive a threaded screw 31 that spans from one aperture, across the slot, and into the second aperture. The threaded screw 31 cooperates with the threaded apertures 30*b* in mutual engagement. Preferably, the threaded screw has a hexagonal socket for its own head that receives a hex key or an Allen® wrench from Apex Tool Group of Dallas, Tex. The threaded screw has sufficient frictional engagement and threaded engagement to the apertures that it remains in position during flight and usage upon and in a target. The remainder of the description for FIG. 8 applies to the rest of the alternate embodiment.

When the time comes, the preferred embodiment and the alternate embodiment of the dual spreading arrowhead stand ready to assist bow hunters of all ages, genders, and abilities in the age old quest to catch game: tally ho!

While a preferred embodiment of the dual spreading arrowhead has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as plastic, polymer, metal, alloy, composite, fiber, and the like may be used. Although an arrowhead for shooting from a bow to a deer or other game has been described, it should be appreciated that the dual spreading arrowhead herein described is also suitable for spears, pikes, poles, and the like used at fields, meadows, pastures, woods, forests, swamps, foothills, mountains, tundra, and like terrain where game roams.

The Applicant reminds the reader that the invention is not a toy. It is not designed for a person to lean upon, stand upon, sit on, nor is it suitable for supporting a load. The present invention has its tips pointed, edges sharpened, and pinch points, thus it is to be treated with respect.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Various aspects of the illustrative embodiments have been described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations have been set forth in order to provide a thorough understanding of the illustrative embodiments. However, it will be apparent to one skilled in the art that the present invention may be practiced without the specific details. In other instances, well known features are omitted or simplified in order not to obscure the illustrative embodiments.

Various operations have been described as multiple discrete operations, in a manner that is most helpful in understanding the present invention, however, the order of description should not be construed as to imply that these operations are necessarily order dependent. In particular, these operations need not be performed in the order of presentation.

Moreover, in the specification and the following claims, the terms "first," "second," "third" and the like—when they appear—are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to allow the reader to ascertain the nature of the technical disclosure. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

As such, those skilled in the art will appreciate that the conception, upon which this disclosure is based, may readily be utilized as a basis for the designing of other structures, methods and systems for carrying out the several purposes of the present invention. Therefore, the claims include such equivalent constructions insofar as they do not depart from the spirit and the scope of the present invention.

I claim:

1. A dual spreading arrowhead for mounting upon a shaft, comprising:

two blades having an elongated trapezoidal form:

said blades operatively connecting by an elongated cylinder through a head, said head having a longitudinal axis and a slot transverse to the longitudinal axis, said blades rotating in said slot and said arrowhead having a longitudinal axis;

a spacer placing into said slot interiorly of said head and said blades;

wherein said dual spreading arrowhead transitions from a flight position with said blades angularly spaced near each other to a deployed position with said blades rotating outwardly from each other and attaining at least one hundred eighty degrees of separation, as during a hunt;

each of said blades having a tip, a first edge inward from said tip, a second edge inward from said first edge, a third edge rotating from said second edge, and a spine from said third edge to said tip;

each of said blades having a front spanning said first edge, said second edge, said third edge, and said spine, and a back opposite said front and mutually parallel and spaced apart from said front; and each of said blades having a shoulder opposite said tip, said shoulder having a rounded form of greater width than the distance from said spine to said second edge, said shoulder including said third edge.

2. The dual spreading arrowhead of claim 1 further comprising:

each of said shoulders having said third edge extending at least ninety degrees in rotation from said second edge, and each of said shoulders extending from said third edge in a square edge to said spine wherein said square edge attains an angle to the longitudinal axis of said dual spreading arrowhead; and said square edges of said shoulders in cooperation with said spacer retaining said blades in the flight position until said tips cut a target upon contact and said blades open to the deployed position.

3. The dual spreading arrowhead of claim 2 further comprising:

said blades stacking back to back and said shoulders entering said slot, said tips positioning away from said head, and said tips orienting mutually outward.

4. The dual spreading arrowhead of claim 2 further comprising:

said spacer having two sloped surfaces abutting said shoulders.

5. The dual spreading arrowhead of claim 4 further comprising:

each of said sloped surfaces abutting one of said shoulders.

6. The dual spreading arrowhead of claim 1 further comprising:

said head having a forward surface orienting towards said blades, a round cylindrical shape having a diameter, a round neck opposite said forward surface and centered upon said head having a diameter, and a round stem outwardly from said neck and centered, upon said neck having a diameter;

said neck having its diameter less than that of said head, said stem having its diameter less than that of said neck;

said head having a length and said slot having a depth at east half of the length of said head; and said head having two coaxial apertures transverse to said slot and to said longitudinal axis of said head wherein said apertures receive said elongated cylinder.

7. The dual spreading arrowhead of claim 6 further comprising:

said forward surface having a bevel.

8. The dual spreading arrowhead of claim 6 wherein said elongated cylinder is either a pin or a screw.

9. The dual spreading arrowhead of claim 8 wherein said elongated cylinder is a screw.

10. A mechanical broadhead capable of mounting upon a shaft, comprising:

a head having a longitudinal axis and a slot transverse to the longitudinal axis;

a spacer placing into said slot;

two blades having an elongated trapezoidal form, said blades operatively connecting by an elongated cylinder, said elongated cylinder inserting into said head rearward of said spacer;

said blades rotating in said slot and said mechanical broadhead having a longitudinal axis; and wherein said mechanical broadhead transitions from a flight position with said blades angularly spaced near each other to a deployed position with said blades rotating outwardly from each other and attaining at least one hundred eighty degrees of separation, as during a hunt;

said head having a forward surface orienting towards said blades, a round cylindrical shape having a diameter, a round neck opposite said forward surface and centered upon said head having its diameter, and a round stem outwardly from said neck and centered upon said neck having its diameter;

said neck having its diameter less than that of said head, said stem having its diameter less than that of said neck;

said head having a length and said slot having a depth at least half of the length of said head, said slot being opposite said neck; and said head having two coaxial apertures transverse to said slot and to said longitudinal axis of said head wherein said apertures receive said elongated cylinder.

11. The mechanical broadhead of claim 10 further comprising:

said forward surface having a bevel.

12. The mechanical broadhead of claim 10 further comprising:

each of said blades having a tip, a first edge inward from said tip, a second edge inward from said first edge, a third edge rotating from said second edge, and a spine from said third edge to said tip;

each of said blades having a front spanning said first edge, said second edge, said third edge, and said spine, and a back opposite said front and mutually parallel and spaced apart from said front;

each of said blades having a foot opposite said tip, each of said feet having a rounded form of greater width than the distance from said spine to said said mechanical broadhead having a longitudinal axis;

each of said feet having said third edge extending at least ninety degrees in rotation from said second edge, and each of said feet extending from said third edge in a square edge to said spine wherein said square edge attains an angle to the longitudinal axis of said mechanical broadhead; and said square edges of said feet in cooperation with said spacer retaining said blades in the flight position until said tips cut a target upon contact and said blades open to the deployed position.

13. The mechanical broad head of claim 12 further comprising:

said spacer having two sloped surfaces abutting said feet.

14. The mechanical broad head of claim 13 further comprising:

said blades stacking back to back and said feet entering said slot, said tips positioning away from said head, and said tips orienting mutually outward;

said spacer having two sloped surfaces abutting said feet; and each of said sloped surfaces abutting said squared edge of one of said feet.

15. A mechanical broadhead capable of mounting upon a shaft, comprising:

two blades having an elongated trapezoidal form;

said blades operatively connecting by an elongated cylinder through a head, said head having a longitudinal axis and a slot transverse to the longitudinal axis, said blades rotating in said slot and said broadhead having a longitudinal axis;

a spacer placing into said slot interiorly of said head and said blades;

wherein said mechanical broadhead transitions from a flight position with said blades angularly spaced near each other to a deployed position with said blades rotating outwardly from each other and attaining at least one hundred eighty degrees of separation, as during a hunt;

each of said blades having a tip, a first edge inward from said tip, a second edge inward from said first edge, a third edge rotating from said second edge, and a spine from said third edge to said tip;

each of said blades having a front spanning said first edge, said second edge, said third edge, and said spine, and a back opposite said front and mutually parallel and spaced apart from said front;

each of said blades having a shoulder opposite said tip, said shoulder having a rounded form of greater width than the distance from said spine to said second edge, said shoulder including said third edge;

said mechanical broadhead having a longitudinal axis;

each of said shoulders having said third edge extending at least ninety degrees in rotation from said second edge, and each of said shoulders extending from said third edge in a square edge to said spine wherein said square edge attains an angle to the longitudinal axis of said mechanical broadhead;

said blades stacking back to back, said shoulders entering said slot, said tips positioning away from said head, and said tips orienting mutually outward; and said square edges of said shoulders in cooperation with said spacer retaining said blades in the flight position until said tips cut a target upon contact and said blades open to the deployed position.

16. The mechanical broadhead of claim 15 further comprising:

said head having a forward surface orienting towards said blades, a round cylindrical shape having a diameter, a round neck opposite said forward surface and centered upon said head having a diameter, and a round stem outwardly from said neck and centered upon said neck having a diameter;

said neck having its diameter less than that of said head, said stem having its diameter less than that of said neck;

said head having a length and said slot having a depth at east half of the length of said head;

said head having two coaxial apertures transverse to said slot and to said longitudinal axis of said head wherein said apertures receive said elongated cylinder;

said forward surface having a bevel;

said spacer having two sloped surfaces abutting said shoulders;

each of said sloped surfaces abutting said squared edge of one of said shoulders; and wherein said elongated cylinder is a pin.

* * * * *